US005391062A

United States Patent [19]

Yoshioka

[11] Patent Number: 5,391,062

[45] Date of Patent: Feb. 21, 1995

[54] ELECTRIC FUEL PUMP WITH ARCUATE RELIEF RECESS

[75] Inventor: Hiroshi Yoshioka, Hiroshima, Japan

[73] Assignee: Mitsubishi Denki Kabushiki Kaisha, Tokyo, Japan

[21] Appl. No.: 159,112

[22] Filed: Nov. 30, 1993

Related U.S. Application Data

[63] Continuation of Ser. No. 989,638, Dec. 11, 1992, abandoned.

[30] Foreign Application Priority Data

Jan. 14, 1992 [JP] Japan ..... 4-004848

[51] Int. Cl.[6] ..... F04B 17/00

[52] U.S. Cl. ..... 417/423.3; 417/423.14; 415/55.1

[58] Field of Search ..... 417/423.3, 423.11, 423.14; 415/55.1

[56] References Cited

U.S. PATENT DOCUMENTS

| | | | |
|---|---|---|---|
| 4,451,213 | 5/1984 | Takei et al. | 417/423.3 |
| 4,586,877 | 5/1986 | Watanabe et al. | 417/365 |
| 4,822,258 | 4/1989 | Matsuda et al. | 417/423.3 |
| 4,854,830 | 8/1989 | Kozawa et al. | 417/423.3 |
| 4,872,806 | 10/1989 | Yamada et al. | 415/55.5 |
| 4,915,582 | 4/1990 | Nishikawa | 415/55.1 |

FOREIGN PATENT DOCUMENTS

| | | |
|---|---|---|
| 63-177693 | 11/1988 | Japan . |
| 336001 | 10/1930 | United Kingdom . |
| 595511 | 12/1947 | United Kingdom . |
| 1059419 | 2/1967 | United Kingdom . |
| 1360721 | 7/1974 | United Kingdom . |

*Primary Examiner*—Richard A. Bertsch
*Assistant Examiner*—Alfred Basichas
*Attorney, Agent, or Firm*—Burns, Doane, Swecker & Mathis

[57] ABSTRACT

An electric fuel pump having high fuel discharge efficiency in which the frictional resistance between the pump casing and the impeller is reduced, and any decrease in the speed of rotation of the motor and increase in power consumption are prevented. According to the present invention, in an electric fuel pump, a relief recess (or clearance) larger in depth than small gaps between an impeller and the slide surfaces of a pump casing through which the impeller is supported by the pump casing is formed in the slide surface which confronts a pump chamber outlet, near the pump chamber outlet and inwardly of the pump chamber.

6 Claims, 2 Drawing Sheets

ELECTRIC FUEL PUMP WITH ARCUATE RELIEF RECESS

This application is a continuation, of application Ser. No. 07/989,638, filed Dec. 11, 1992, now abandoned.

BACKGROUND OF THE INVENTION

This invention relates to an in-tank type electric fuel pump which is built in the fuel tank of a motor vehicle or the like to supply fuel to the engine under pressure, and more particularly to an improvement of the fuel discharge efficiency of the electric fuel pump.

FIG. 4 is a side view, with parts cut away, showing the arrangement of a conventional electric fuel pump of this type. FIG. 5 is a sectional view taken along V—V in FIG. 4.

In those figures, reference numeral 1 designates a disk-shaped impeller having vane grooves 1*a* formed in its peripheral portion in such a manner that they are extended radially; 2, a pump cover with a slide surface 2*a* which confronts with one surface of the impeller 1 with a small gap therebetween, thus supporting the impeller 1; 3, a pump base having a slide surface 3*a* which confronts with the other surface of the impeller 1 with a small gap therebetween, thus supporting the impeller 1; 4, an arcuate-belt-shaped pump chamber provided outside the slide surfaces 2*a* and 3*a* of the pump cover 2 and the pump base 3 and along the periphery of the impeller 1; 5, a fuel suction inlet provided on the side of the pump cover 2; and 6, a pump chamber outlet provided on the side of the pump base. Those components 2 through 6 form a pump casing 7. Further in FIGS. 4 and 5, reference numeral 8 designates a motor shaft on which the impeller 1 is mounted; 9, an armature; 10, magnets; 11, a cylindrical housing on which the magnets 10 is mounted, the housing 11 being engaged with the pump casing 7. Those components 8 through 11 form a motor section 12. Further in FIGS. 4 and 5, reference numeral 13 designates the motor chamber of the motor section 12; and 14, a fuel discharge outlet.

When the motor section 12 operates, the impeller 1 is rotated, so that a fuel (not shown) is sucked through the fuel suction inlet 5 into the fuel pump body. The fuel thus sucked is pressurized in the pump chamber 4, so that it is supplied through the pump chamber outlet 6 into the motor chamber 13, and then discharged through the fuel discharge outlet 14.

In the above-described regeneration type electric fuel pump, in order to prevent the lowering of its discharge efficiency; i.e., a loss of fuel leakage which occurs between the surfaces of the impeller and the slide surfaces of the pump cover and the pump base, the gaps in the direction of thrust are held minimum at all times. Hence, when the pressure of the fuel in the pump chamber is increased from the fuel suction inlet towards the pump chamber outlet by rotation of the vane grooves, in the pump casing the pressure near the pump chamber outlet is unbalanced with that near the fuel suction inlet, so that the impeller is rotated while contacting the part of the pump casing which confronts with the pump chamber outlet. FIG. 5 shows scratches 15 which are formed on the pump casing when the impeller contacts the pump casing near the pump chamber outlet. As a result, the rotation of the impeller 1 is subject to increased frictional resistance, and therefore the motor is decreased in the speed of rotation, and power consumption is increased. That is, the electric fuel pump is subject to decreased discharge efficiency.

SUMMARY OF THE INVENTION

Accordingly, an object of this invention is to eliminate the above-described difficulties accompanying a conventional electric fuel pump. More specifically, an object of the invention is to provide an electric fuel pump in which the contact of the impeller with the pump casing is prevented, and therefore the rotation of the impeller is subject only to low frictional resistance.

According to the invention, there is provided an electric fuel pump in which a relief recess larger in depth than small gaps between the impeller and the slide surfaces of the pump casing through which the impeller is supported by the pump casing is formed in the slide surface which is confronted with the pump chamber outlet, near the pump chamber outlet and inwardly of the pump chamber.

The relief recess deeper then the small gaps between the impeller and the slide surfaces of the pump casing substantially eliminate the contact of the impeller with the pump housing, thus reducing the frictional resistance in rotation of the impeller.

DETAILED DESCRIPTION OF THE PREFERRED EMBODIMENT

Figure 1:
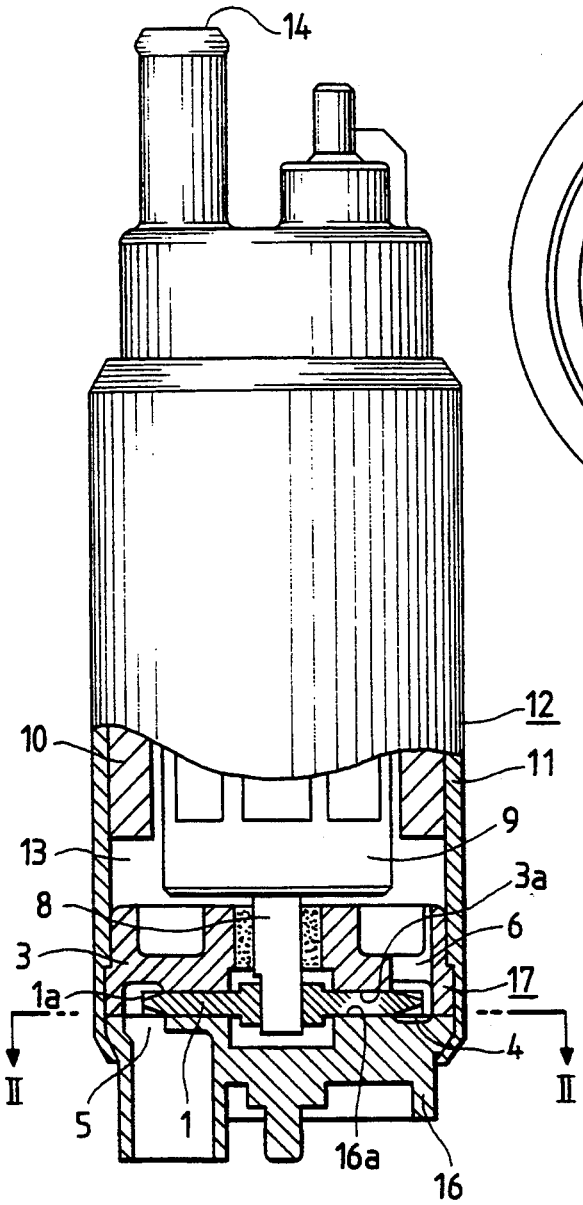
FIG. 1 is a side view, with parts cut away, showing the arrangement of an electric fuel pump, which constitutes one embodiment of this invention.
Figure 2:
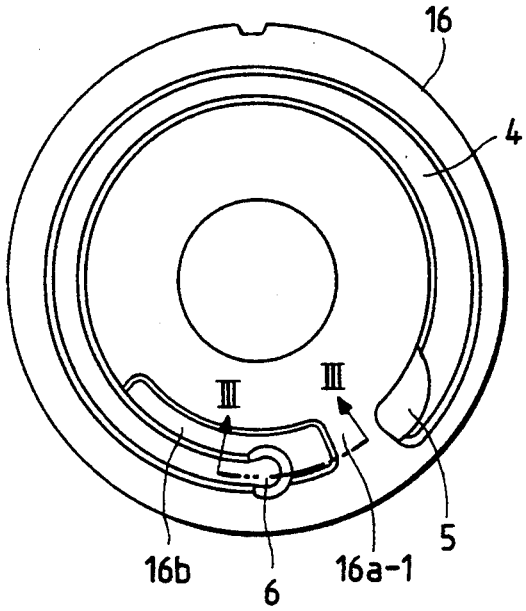
FIG. 2 is a sectional view taken along line II—II in FIG. 1.
Figure 3:
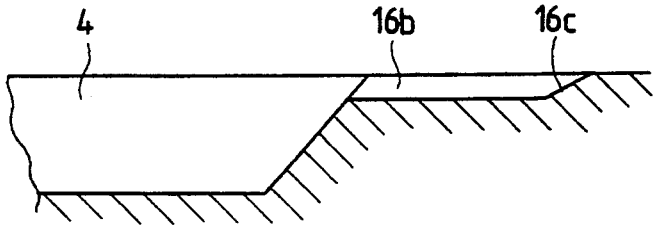
FIG. 3 is a sectional view taken along line III—III in FIG. 2.
Figure 4:
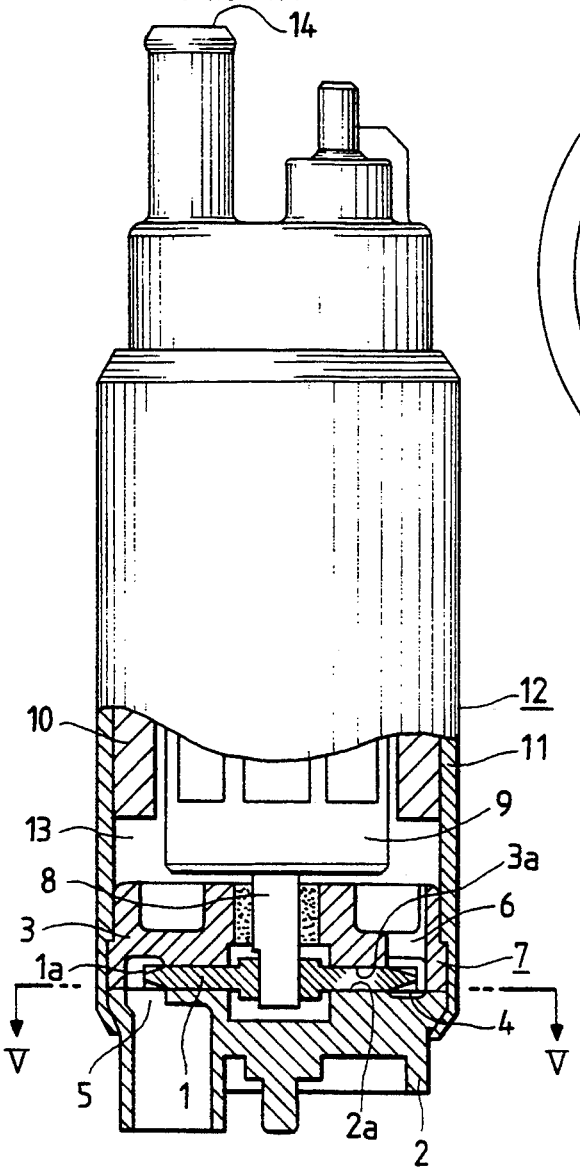
FIG. 4 PRIOR ART
FIG. 4 is a side view, with pars cut away, showing the arrangement of a conventional electric fuel pump.
Figure 5:
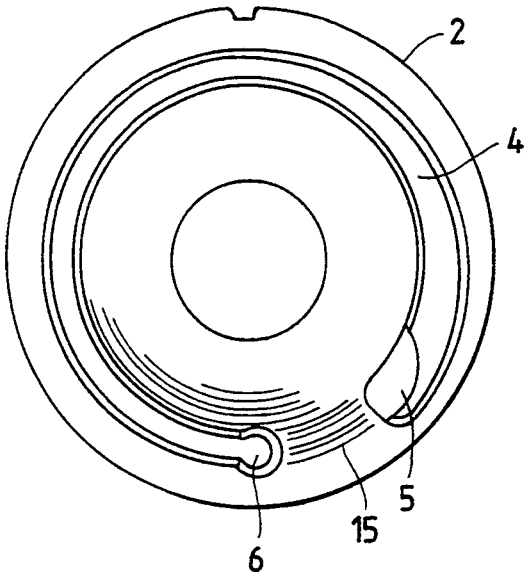
FIG. 5 PRIOR ART
FIG. 5 is a sectional view taken along line V—V in FIG. 4.

An electric fuel pump, which constitutes an embodiment of this invention, will be described with reference to FIGS. 1 through 3. FIG. 1 is a side view, with parts cut away, showing the electric fuel pump according to the invention. FIG. 2 is a sectional view taken along line II—II in FIG. 1. FIG. 3 is also a sectional view taken along line III—III in FIG. 2. In those figures, reference numerals 1, 3 through 6, and 8 through 14 designate the same parts as those in the above-described prior art (FIGS. 4 and 5).

In FIGS. 1 through 3, reference numeral 16 designates a pump cover with a slide surface 16*a* which confronts through a small gap with one surface of the impeller 1, thus supporting the latter 1. A relief recess 16*b* larger in depth than the aforementioned small gaps is formed in the slide surface 16*a* near the pump chamber outlet and inwardly of a pump chamber 4. The relief recess 16*b* is tapered at the end as indicated at 16*c* in FIG. 3. The pump cover 16 is combined with the pump base 3, thus forming a pump casing 17 having a pump chamber 4 inside. The configuration of the relief recess 16*b* corresponds to that of the scratches 15 (FIG. 5) which are formed when the impeller 1 contacts the pump cover 16. In other words, the relief recess 16*a* has a first portion radially inward of and congruent with the pump chamber 4, and a second portion contiguous with the first portion and extending circumferentially past the fuel or pump chamber outlet, with the second portion being as wide in a radial direction as the first portion and pump chamber 4 together. The pump cover 16 has a shutoff portion 16a-1 which is provided only between the pump chamber outlet 6 and the fuel suction inlet 5. This is to prevent the lowering of the discharge efficiency of the pump which is due to a loss of fuel leakage which may occur between the pump chamber outlet 6 and the fuel suction inlet 5.

When the motor section 12 operates, the impeller is rotated to suck the fuel, and the fuel thus sucked is pressurized in the pump chamber 4, and then discharged through the pump chamber outlet 6. In this operation, because of the imbalance in pressure the impeller tends to contact the part of the slide surface 16a which confronts with the pump chamber outlet; however, since the recess 16b is formed in that part, the contact of the impeller is prevented.

As was described above, in the electric fuel pump according to the invention, the relief recess larger than the small gaps between the impeller and the slide surfaces of the pump casing through which the impeller is supported by the pump casing is formed in the slide surface which is confronted with the pump chamber outlet, near the pump chamber outlet and inwardly of the pump chamber. Hence, the electric fuel pump is free from the difficulty that the impeller contacts the slide surface of the pump casing. Thus, in the electric fuel pump, the rotation of the impeller is low in frictional resistance, and the fuel discharge efficiency is high.

What is claimed is:

1. An electric fuel pump comprising:

a disk-shaped impeller having vane grooves in the periphery;

a pump casing including:

slide surfaces defined by confronting said pump casing with both sides of said impeller through small gaps to support said impeller;

an arcuate-belt-shaped pump chamber extended outside said slide surfaces and along the periphery of said impeller, said arcuate-belt-shaped pump chamber having a fuel suction inlet at one end and a pump chamber outlet at the other end; and an electric motor section for driving said impeller, wherein a relief recess larger in depth than said small gaps is formed in said slide surface which is confronted with said pump chamber outlet, near said pump chamber outlet and inside said pump chamber, said relief recess extending circumferentially along the periphery of said impeller and past said pump chamber outlet.

2. An electric fuel pump as claimed in claim 1, said relief recess is formed along the periphery of said impeller with an arcuate-belt-shape.

3. An electric fuel pump, comprising:

a disk-shaped impeller having a first side and a second side;

an electric motor section mechanically coupled to said impeller for rotating said impeller in a first circumferential direction; and a pump casing including a substantially circular first casing surface confronting said first side, said first casing surface having structure defining a first slide surface confronting said first side across a first gap, an arcuate pump chamber radially outside of said slide surface along a path of a periphery of said impeller as said impeller rotates, said arcuate pump chamber having a fuel inlet at one end and a fuel outlet at the other end, and an arcuate relief recess formed in said first casing surface radially inwardly of said pump chamber between said first slide surface and said arcuate pump chamber, said recess extending circumferentially alone the periphery of said impeller and past said fuel outlet in said first circumferential direction.

4. A fuel pump as claimed in claim 3 wherein said arcuate relief recess is all of one depth except for a tapered edge.

5. An electric fuel pump, comprising:

a disk-shaped impeller having a first side and a second side;

an electric motor section mechanically coupled to said impeller for rotating said impeller in a first circumferential direction; and a pump casing including a substantially circular first casing surface confronting said first side, said first casing surface having structure defining a first slide surface confronting said first side across a first gap, an arcuate pump chamber radially outside of said slide surface along a path of a periphery of said impeller as said impeller rotates, said arcuate pump chamber having a fuel inlet at one end and a fuel outlet at the other end, and a relief recess formed in said first casing surface, said relief recess having a first portion which is radially inward of and contiguous with said pump chamber near said fuel outlet, and a second portion contiguous with said first portion and extending circumferentially along the periphery of said impeller and past said fuel outlet in said first direction, said second portion being substantially as wide in a radial direction as said first portion and said pump chamber together.

6. A fuel pump as claimed in claim 5 wherein said relief recess is all of one depth except for a tapered edge.

* * * * *